US006774094B2

(12) United States Patent
Jovancicevic et al.

(10) Patent No.: US 6,774,094 B2
(45) Date of Patent: Aug. 10, 2004

(54) DRAG REDUCTION USING FATTY ACIDS

(75) Inventors: Vladimir Jovancicevic, Richmond, TX (US); Keith A. Bartrip, Baytown, TX (US)

(73) Assignee: Baker Hughes Incorporated, Houston, TX (US)

( * ) Notice: Subject to any disclaimer, the term of this patent is extended or adjusted under 35 U.S.C. 154(b) by 373 days.

(21) Appl. No.: 09/944,837

(22) Filed: Aug. 30, 2001

(65) Prior Publication Data

US 2002/0183214 A1 Dec. 5, 2002

Related U.S. Application Data

(60) Provisional application No. 60/286,228, filed on Apr. 24, 2001.

(51) Int. Cl.[7] ..... C10M 129/26; C10M 129/60

(52) U.S. Cl. ..... 508/506; 508/463; 508/517; 508/539

(58) Field of Search ..... 508/463, 500, 508/506, 517, 539

(56) References Cited

U.S. PATENT DOCUMENTS

| | | | | |
|---|---|---|---|---|
| 3,351,079 | A | 11/1967 | Gibson | |
| 3,361,213 | A | 1/1968 | Savins | |
| 3,434,485 | A | 3/1969 | Lummus | |
| 3,667,152 | A | 6/1972 | Eckert | |
| 4,426,208 | A | 1/1984 | Perilstein | |
| 4,927,669 | A | 5/1990 | Knox et al. | |
| 4,958,653 | A | 9/1990 | Lowther | |
| 5,183,475 | A | 2/1993 | Cardis et al. | |
| 5,385,616 | A | 1/1995 | Dougherty et al. | |
| 5,582,792 | A | 12/1996 | Dougherty et al. | |
| 6,042,750 | A | 3/2000 | Burlew | |
| 2002/0173569 | A1 * | 11/2002 | Karhu et al. | 524/313 |

FOREIGN PATENT DOCUMENTS

| | | |
|---|---|---|
| EP | 0 471 465 A2 A3 | 2/1992 |
| FR | 2340993 | 9/1977 |
| GB | 839112 | 6/1960 |
| GB | 1556688 | 11/1979 |
| WO | WO 97/01582 A1 | 1/1997 |
| WO | WO 98/16586 A1 | 4/1998 |

OTHER PUBLICATIONS

PCT International Search Report for PCT/US02/07564, Sep. 13, 2002.

J. G. Savins, "Contrasts in the Solution Drag Reduction Characteristics of Polymeric Solutions and Micellar Systems," in C. S. Wells, ed., Viscous Drag Reduction, Plenum Press, New York, 1969, pp. 183–212.

W.–M. Kuiicke, et al., "Drag Reduction with Special Emphasis on Homogeneous Polymer Solutions," Advances in Polymer Science, vol. 89, 1989, pp. 1–68.

Y. Hu, et al., "Rheological and Rheo–optical Characterization of Shear–induced Structure Formation in a Nonionic Drag–Reducing Surfactant Solution," J. Rheol., vol. 41, No. 1, Jan./Feb. 1997, pp. 151–166.

A. Salem, et al., "The Effects of Heterogeneous Drag Reducing Surfactant in Drag and Heat Transfer Reduction in Crude Oil Systems," Chem. Eng. Comm. vol. 168, pp. 229–242.

J. L. Zakin, et al., "Surfactant Drag Reduction," Reviews in Chemical Engineering, vol. 14, Nos. 4–5, 1998, pp. 253–320.

Ying–Hsiao Li, et al., "Laboratory Tests and Field Implementation of Gas–Drag–Reduction Chemicals," SPE Production & Facilities, Feb. 1998, pp. 53–58.

* cited by examiner

*Primary Examiner*—Ellen M. McAvoy
(74) *Attorney, Agent, or Firm*—Madan, Mossman & Sriram P.C.

(57) ABSTRACT

Non-polymeric fatty acid drag reducing agents are described herein. These additives are useful to reduce drag in hydrocarbon fluids and multiphase fluids of hydrocarbon(s) and water. No injection probes or other special equipment is expected to be required to introduce the drag reducing agent into the liquid stream, nor is grinding (cryogenic or otherwise) of the additive necessary to form a suitable drag reducing agent. The drag reducing additives of the invention are not subject to shear degradation and do not cause undesirable changes in the emulsion or fluid quality of the fluid being treated, or undesirable foaming. The drag reducing additives include fatty acids, alkoxylated derivatives of fatty acids, organic and inorganic salts of fatty acids and alkoxylated derivatives thereof, and esters of fatty acids and alkoxylated derivatives thereof, and mixtures thereof.

16 Claims, No Drawings

DRAG REDUCTION USING FATTY ACIDS

This application claims the benefit of Provisional Application No. 60/286,228, filed Apr. 24, 2001.

FIELD OF THE INVENTION

The invention relates to agents to be added to fluids flowing through a conduit to reduce the drag therethrough, and most particularly relates, in one non-limiting embodiment, to non-polymeric drag reducing agents (DRAs) for liquids such as hydrocarbons, and emulsions of water and hydrocarbons.

BACKGROUND OF THE INVENTION

The use of polyalpha-olefins or copolymers thereof to reduce the drag of a hydrocarbon flowing through a conduit, and hence the energy requirements for such fluid hydrocarbon transportation, is well known. These drag reducing agents or DRAs have taken various forms in the past, including slurries of ground polymer particulates. A problem generally experienced with simply grinding the polyalpha-olefins (PAOs) is that the particles will "cold flow" or stick together after the passage of time, thus making it impossible to place the PAO in the hydrocarbon in a form that will dissolve or otherwise mix with the hydrocarbon in an efficient manner. Further, the grinding process irreversibly degrades the polymer, thereby reducing the drag reduction efficiency of the polymer.

One common solution to preventing cold flow is to coat the ground polymer particles with an anti-agglomerating agent. Cryogenic grinding of the polymers to produce the particles prior to or simultaneously with coating with an anti-agglomerating agent has also been used. However, some powdered or particulate DRA slurries require special equipment for preparation, storage and injection into a conduit to ensure that the DRA is completely dissolved in the hydrocarbon stream.

Gel or solution DRAs have also been tried in the past. However, these drag reducing gels also demand specialized injection equipment, as well as pressurized delivery systems. They are also limited to about 10% polymer as a maximum concentration in a carrier fluid due to the high solution viscosity of these DRAs. Thus, transportation costs of the DRA are considerable, since up to about 90% of the volume being transported and handled is inert material.

Further, polymeric DRAs additionally suffer from the problem that the high molecular weight polymer molecules can be irreversibly degraded (reduced in size and thus effectiveness) when subjected to conditions of high shear, such as when they pass through a pump. Additionally, some polymeric DRAs can cause undesirable changes in emulsion or fluid quality, or cause foaming problems when used to reduce the drag of multiphase liquids.

Surfactants, such as quaternary ammonium salt cationic surfactants, are known drag reducing agents in aqueous (non-hydrocarbon) systems and have the advantage over polymeric DRAs in that they do not degrade irreversibly when sheared. In contrast, flow-induced structures in surfactant solutions are reversible.

Thus, it would be desirable if a drag reducing agent could be developed which rapidly dissolves in the flowing hydrocarbon or emulsion, which could minimize or eliminate the need for special equipment for preparation and incorporation into the hydrocarbon or emulsion, and which could avoid shear degradation. It would be desirable to develop a drag reducing agent that does not cold flow and thus requires the use of cryogenic grinding and/or the extra addition of an anti-agglomeration additive.

SUMMARY OF THE INVENTION

An object of the invention is to provide a DRA that does not require the use of a polymeric material.

Other objects of the invention include providing a DRA that can be readily manufactured and which does not require special equipment for placement in a conduit transporting hydrocarbons or other fluids.

Another object of the invention is to provide a DRA that does not cold flow upon standing and is stable.

In carrying out these and other objects of the invention, there is provided, in one form, a method of reducing drag of a fluid involving first providing a fluid, and then adding to the fluid an amount of an additive effective to reduce the drag of the fluid. The additive is a fatty acid, an alkoxylated derivative of a fatty acid, an organic or inorganic salt of a fatty acid or an alkoxylated derivative thereof, or an ester of a fatty acid or an alkoxylated derivative thereof, and mixtures thereof.

DETAILED DESCRIPTION OF THE INVENTION

The present invention relates to methods and compositions for reducing drag in multiphase flowlines (for example oil/water, water/oil, oil/water/gas) in oil and gas production systems. It is expected that the invention could apply to any hydrocarbon fluid flowing in a pipeline, whether or not water is present. It will be appreciated that by the term "hydrocarbon fluid", it is expected that oxygenated hydrocarbons such as methanol, ethanol, ethers, and the like may be included within the definition. The term "hydrocarbon fluid" also means any fluid that contains hydrocarbons, as defined herein to also include oxygenated hydrocarbons.

Many oil and gas production systems (e.g. those found in deep water rigs of the Gulf of Mexico) are limited in their production due to pressure drop in the flowlines under turbulent flow regime. The drag reducing methods of the invention comprise applying additives to the system by either batch or continuous treatments at high enough concentrations to produce the desired reduction in drag and/or increase in flow for the same amount of motive energy. The compositions containing the additive are used effectively by maintaining drag reduction effectiveness over an extended period of time. The use of these types of additives present distinct advantages over the use of conventional polymeric drag reducers including the facts that they are not shear sensitive and do not cause undesirable changes in emulsion, foaming or fluid quality. Without wishing to be limited to any particular mechanism of operation, the microstructures or associations between the molecules of the inventive additives are believed to reform after the fluid is sheared. Reduction in pressure drop in gas and oil multiphase flowlines by using fatty acid and/or fatty acid derivatives allows operators to increase production. The oil/water solubility and/or dispersibility characteristics of the additive can be varied to allow their use in a broad range of oil/water ratios. A mixture of additives, e.g. tall oil fatty polyacids, with various oil/water solubilities can be used to cover a wide range of applications.

The drag reducing additives of this invention have the basic chemical structures of fatty acids, namely a hydrocarbon moiety having one or more carboxylic acid groups (—COOH). In one non-limiting embodiment, the number of carbon atoms in the carboxylic acid range from about 4 to about 100, preferably from about 8 to about 64 carbon atoms. In one non-limiting embodiment of the invention, linear and branched saturated and unsaturated carboxylic acids are included as additives of the invention. Such fatty acids may have a carbon number range of from 4 to 34, preferably from 8 to 20. Specific examples of such fatty acids include, but are not necessarily limited to, oleic acid, linoleic acid, stearic acid, palmitic acid, and the like.

The additives of this invention may also include alkoxylated derivatives of fatty acids. By "alkoxylated fatty acid derivative" is meant any fatty acid that has been reacted with an alkoxide using known or future methods. The alkoxide may include, but is not necessarily limited to ethylene oxide, propylene oxide, butylene oxide and mixtures thereof. In one embodiment of the invention, the extent of alkoxylation should not be so great as to interfere with the objectives of the invention, which include solubility in the fluid. In one non-limiting example, the extent of alkoxylation may range from about 1 to about 100 alkoxy units, preferably from about 5 to about 20 alkoxy units. Again, the alkoxy units may be mixed types, and may be present in blocks or random arrangement.

The basic chemical structure of the tall oil fatty dimer acid drag reducers of this invention is given below:

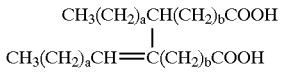

Acyclic

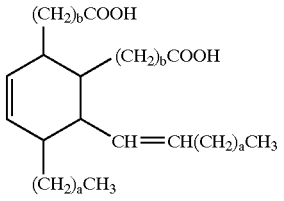

Monocyclic

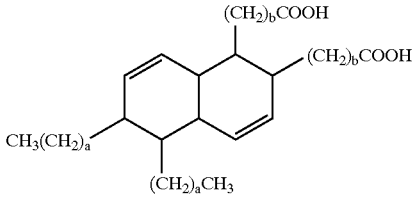

Bicyclic where the sum of any one a and b averages 14.

The structure of the trimer acid of the acyclic type is given below:

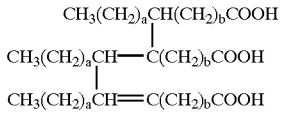

again where the sum of any one a and b averages 14.

The additives of this invention also include any organic or inorganic salts of the defined fatty acids or alkoxylated fatty acids. Examples of suitable salts include, but are not necessarily limited to amine salts of these materials, amide salts, imidazoline salts, hydroxylamine salts, halide salts (e.g. sodium and/or potassium salts) of these materials and mixtures thereof. Esters of the defined fatty acids or alkoxylated fatty acids are also included within the definitions of the additives of this invention. Suitable esters of this invention include those where the alkyl substituent of the ester group contains from about 1 to about 20 carbon atoms, preferably from about 6 to about 16 carbon atoms. The ester alkyl group may be straight or branched. In one non-limiting embodiment, the corresponding esters of methanol, ethanol, and isopropanol of the dimer and/or trimer acids or other acids are preferred.

In one non-limiting embodiment of this invention, the drag reducing additives are dimer acid, trimer acid, tetramer acid, and/or mixtures thereof. Generally, dimer acid is about $C_{36}$ and trimer acid is about $C_{54}$, generally made by dimerizing and trimerizing stearic acid (octadecanoic acid), respectively. However, dimer and trimer fatty acids can be made in general from other monofatty acids. Tall oil derived dimer and trimer acids and mixtures thereof are preferred in one non-limiting embodiment of the invention. For the purposes of this invention, dimer acid, trimer acid, and tetramer acid are oligomers and not polymers.

In one non-limiting embodiment of the invention, the drag reducing additives herein are added in the absence of any polymeric drag reducing additive. In another non-limiting embodiment of the invention, the drag reducing additives are employed in the absence of any other drag reducing additive, i.e. one that does not fall within the definitions of this invention. In an additional non-limiting embodiment of the invention, the drag reducing additives are added in the absence of any long chain aluminum soaps. On the other hand, there may be situations or environments where it is advantageous to employ other drag reducing additives together with those of this invention in effective mixtures, such mixtures being within the bounds of this invention.

Compounds such as these fatty acids are known to find use in soaps, lubricants, paints and lacquers, synthetic detergents, emulsifiers, among other applications. The use of fatty acids (and their derivatives) as drag reducers that are the subject of this invention, however, requires substantially higher use concentrations than those for some other uses. The typical use levels in the actual system for drag reduction is approximately 5–10 times higher than that for corrosion inhibitor additives, based on total system fluid, i.e. from about 100 to 1000 ppm for methods of this invention, preferably from about 150 to about 600 ppm, and most preferably from about 200 ppm to about 500 ppm. The maximum drag reduction effects observed, including both pressure reduction ($\Delta P$) and flow increase (Q), in the laboratory testing were between 5–20%, depending on oil/water ratio, flow rates and type of test (Torque vs. Flow Loop). It will be appreciated that it is virtually impossible to predict in advance what an effective amount of drag reducing agent would be in any particular circumstance since, as noted, there are a number of interrelated factors that must be considered including, but not necessarily limited to, the type of fluid having its friction characteristics modified, the flow rate of the fluid, the temperature of the fluid, the nature of the DRA, etc. Thus, the dosage ranges given above and used in the Examples should be understood as illustrative only.

The preferred manner of practicing the invention is batch treatment between two pigs or continuous treatment at the well head or pipeline through umbilical or capillary. In the continuous treatment, the product solution is used at high enough concentration to produce the desired drag reduction without causing emulsion, foaming or other oil/water quality problems.

The fatty acids, esters and salts thereof may be combined with any suitable solvent prior to use as a drag reducing agent. Such solvents include, but are not necessarily limited to, aromatic solvents, aliphatic solvents, alcohols, ethers, esters, water, and mixtures thereof. To further illustrate the invention, the inventive method will be additionally described by way of the following non-limiting Examples, which are intended only to further show specific embodiments of the invention.

EXAMPLE 1

The final tests were carried out in the DRA flow loop with different oil/brine (O/B) ratios. A recirculated DRA flow loop was used to measure drag reduction properties (ΔP, flow, fluid density) of DRAs. The flow loop circulated 30 liters of fluid through a ½-inch ID stainless steel pipe (4-foot long section) equipped with a differential pressure transducer. Differential pressure (ΔP), flow rate (Q), fluid density, pressure and temperature were measured continuously during the test. Only the reduction in ΔP accompanied with a corresponding increase in Q as a result of the addition of DRA was considered as an indication of drag reduction.

The mass flow rate and density of fluids were measured using a mass flow meter, while ΔP was measured using a differential pressure transducer. The concentration of DRA was varied from 75–300 ppm. All experiments were carried out at 140° F. and 100 psi $CO_2$. The pressure drop (ΔP), flow rate (Q), change in pressure drop (δΔP), change in flow rate (δQ) and calculated Fanning friction factor (f) were obtained using product A (tall oil derived dimer-trimer acid) and product B (maleated fatty acid) drag reducers as shown in Table 1. The reduction in Fanning friction factor for these two chemicals in 70/30 oil/brine mixture was close to 25%.

TABLE I

DRA Flow Loop Data

| DRA | O/B Ratio | ΔP (psi) | δΔP (%) | Q (lb/min) | δQ | f |
|---|---|---|---|---|---|---|
| Blank | 30/70 | 6.90 | | 126.0 | | 0.0053 |
| | 50/50 | 6.70 | | 115.0 | | 0.047 |
| | 70/30 | 6.50 | | 117.0 | | 0.0041 |
| | 90/10 | 6.10 | | 95.0 | | 0.0055 |
| A | 30/70 | | | | | |
| | 50/50 | 6.35 | −5.2 | 119.9 | 4.3 | 0.0041 |
| | 70/30 | 5.67 | −12.8 | 126.4 | 8.0 | 0.0031 |
| | 90/10 | 5.87 | −3.8 | 99.1 | 4.3 | 0.0049 |
| B | 30/70 | 6.57 | −4.7 | 130.4 | 3.5 | 0.0047 |
| | 50/50 | 6.37 | −5.0 | 119.1 | 3.6 | 0.0042 |
| | 70/30 | 6.32 | −2.8 | 119.9 | 2.5 | 0.0038 |
| | 90/10 | | | | | |

Many modification may be made in the composition and implementation of this invention without departing from the spirit and scope thereof that are defined only in the appended claims. For example, the exact combination of drag reducing additive(s) and liquid having its friction properties modified may be different from those used here. Additionally, derivatives other than those specifically mentioned may find utility in the methods of this invention. Various combinations of fatty acids or derivatives thereof, alone or together with other materials besides those explicitly mentioned herein, are also expected to find use as drag reducing agents.

We claim:

1. A method of reducing drag of a fluid, comprising:

providing a fluid selected from the group consisting of hydrocarbons, mixtures of hydrocarbons and water, and mixtures of hydrocarbons, water and gas; and adding to the fluid from about 100 to about 1000 ppm of an additive based on the total amount of fluid effective, where the additive is selected from the group consisting of fatty acids, alkoxylated derivatives of fatty acids, halide salts of fatty acids and alkoxylated derivatives thereof, and esters of fatty acids and alkoxylated derivatives thereof, and mixtures thereof, in the absence of a polymeric drag reducing additive.

2. The method of claim 1 where the additive averages from about 4 to about 60 carbon atoms.

3. The method of claim 1 where the additive is selected from the group consisting of tall oil derived dimer acid, tall oil derived trimer acid, and mixtures thereof.

4. The method of claim 1 where the amount of additive based on the total amount of fluid ranges from about 150 to 1000 ppm.

5. The method of claim 1 further comprising adding more than one additive.

6. A method of reducing drag of a fluid, comprising:

providing a fluid selected from the group consisting of hydrocarbons, mixtures of hydrocarbons and water, and mixtures of hydrocarbons, water and gas; and adding to the fluid from about 150 to 600 ppm of an additive based on the total amount of fluid, where the additive is selected from the group consisting of fatty acids, alkoxylated derivatives of fatty acids, halide salts of fatty acids and alkoxylated derivatives thereof, and esters of fatty acids and alkoxylated derivatives thereof and mixtures thereof, and where the additive averages from about 4 to about 60 carbon atoms, in the absence of a polymeric drag reducing additive.

7. The method of claim 6 where the additive is selected from the group consisting of tall oil derived dimer acid, tall oil derived trimer acid, and mixtures thereof.

8. The method of claim 6 further comprising adding more than one additive.

9. A reduced drag fluid, comprising:

a fluid selected from the group consisting of hydrocarbons, mixtures of hydrocarbons and water, and mixtures of hydrocarbons, water and gas; and from about 100 to about 1000 ppm of an additive based on the total amount of the fluid, where the additive is selected from the group consisting of fatty acids, alkoxylated derivatives of fatty acids, halide salts of fatty acids and alkoxylated derivatives thereof, and esters of fatty acids and alkoxylated derivatives thereof, and mixtures thereof, in the absence of a polymeric drag reducing additive.

10. The reduced drag fluid of claim 9 where the additive averages from about 4 to about 60 carbon atoms.

11. The reduced drag fluid of claim 9 where the additive is selected from the group consisting of tall oil derived dimer acid, tall oil derived trimer acid, and mixtures thereof.

12. The reduced drag fluid of claim 9 where the amount of additive based on the total amount of fluid ranges from about 150 to 1000 ppm.

13. The reduced drag fluid of claim 9 further comprising more than one additive.

14. A reduced drag fluid, comprising:

a fluid selected from the group consisting of hydrocarbons, mixtures of hydrocarbons and water, and mixtures of hydrocarbons, water and gas; and from about 150 to 1000 ppm of an additive based on the total amount of fluid, where the additive is selected from the group consisting of fatty acids, alkoxylated derivatives of fatty acids, halide salts of fatty acids and alkoxylated derivatives thereof, and esters of fatty acids and alkoxylated derivatives thereof and mixtures thereof, and where the additive averages from about 4 to about 60 carbon atoms, in the absence of a polymeric drag reducing additive.

15. The reduced drag fluid of claim 14 where the additive is selected from the group consisting of tall oil derived dimer acid, tall oil derived trimer acid, and mixtures thereof.

16. The reduced drag fluid of claim 14 further comprising more than one additive.

* * * * *